US008079942B2

(12) United States Patent
Anderson

(10) Patent No.: US 8,079,942 B2
(45) Date of Patent: Dec. 20, 2011

(54) ARCHERY TRAINING DEVICE

(76) Inventor: Kim A. Anderson, Perham, MN (US)

( * ) Notice: Subject to any disclaimer, the term of this patent is extended or adjusted under 35 U.S.C. 154(b) by 0 days.

(21) Appl. No.: 12/801,690

(22) Filed: Jun. 21, 2010

(65) Prior Publication Data

US 2011/0028288 A1 Feb. 3, 2011

Related U.S. Application Data

(60) Provisional application No. 61/213,907, filed on Jul. 28, 2009.

(51) Int. Cl.
*A63B 20/02* (2006.01)

(52) U.S. Cl. ..... 482/121; 482/126

(58) Field of Classification Search ..... 482/121–129, 482/148; 124/83–90
See application file for complete search history.

(56) References Cited

U.S. PATENT DOCUMENTS

| | | | | |
|---|---|---|---|---|
| 2,496,140 | A * | 1/1950 | Virneburg | 124/22 |
| 3,256,015 | A * | 6/1966 | Perrin | 482/129 |
| 4,245,840 | A * | 1/1981 | Van Housen | 482/124 |
| 4,279,601 | A * | 7/1981 | Cobelli | 434/247 |
| 4,609,191 | A * | 9/1986 | Remme | 482/122 |
| 4,741,528 | A | 5/1988 | Church | |
| 5,277,170 | A * | 1/1994 | Carella | 124/86 |
| 5,314,396 | A * | 5/1994 | Parr | 482/126 |
| 5,592,928 | A * | 1/1997 | Frasier | 124/1 |
| 5,741,207 | A * | 4/1998 | Buoni et al. | 482/124 |
| 5,885,196 | A * | 3/1999 | Gvoich | 482/125 |
| 6,726,606 | B2 * | 4/2004 | Jacobsen | 482/121 |
| 7,322,909 | B1 * | 1/2008 | Loccarini et al. | 482/129 |
| 7,387,599 | B1 * | 6/2008 | Hsu | 482/132 |
| 7,465,259 | B2 * | 12/2008 | Mok | 482/126 |
| 2007/0254786 | A1 * | 11/2007 | Owen | 482/121 |
| 2008/0032876 | A1 | 2/2008 | Mukenev | |

FOREIGN PATENT DOCUMENTS

| | | |
|---|---|---|
| DE | 32 31 228 A1 | 2/1984 |
| WO | WO 91/06820 A1 | 5/1991 |

* cited by examiner

*Primary Examiner* — Stephen Crow
(74) *Attorney, Agent, or Firm* — Richard C. Litman

(57) ABSTRACT

The archery training device allows an archer to properly train his or her muscles, as well as train for proper archery technique. The archery training device includes a support having a plurality of pairs of apertures formed therethrough. A plurality of elastic members each has opposed first and second ends, which are respectively received within one of the plurality of pairs of apertures and attached to the support. Optionally, the upper end of an elastic band may be releasably attached to the support. A lower end of the optional elastic band is adapted for being held against a support surface by the foot of the archer. In use, the archer grasps the support with the bow hand and grasps a selected number of the plurality of elastic members with the string hand to simulate a string pull of an archery bow.

10 Claims, 4 Drawing Sheets

ARCHERY TRAINING DEVICE

CROSS-REFERENCE TO RELATED APPLICATION

This application claims the benefit of U.S. Provisional Patent Application Ser. No. 61/213,907, filed Jul. 28, 2009.

BACKGROUND OF THE INVENTION

1. Field of the Invention

The present invention relates to exercise devices and particularly to an archery training device that is resistance-based and provides for both training and exercise.

2. Description of the Related Art

Archery is the art, practice, or skill of propelling arrows with the use of a bow. Archery has historically been used for hunting and combat. However, in modern times, its main use is that of a recreational activity. While there is great variety in the construction of bows, all bows consist of a string attached to elastic limbs that store mechanical energy imparted by the user drawing the string. Bows may be broadly split into two categories: those drawn by pulling the string directly and those that use a mechanism to pull the string.

In use, the bow is held in the hand opposite to the archer's dominant eye, though holding the bow in the dominant hand side is advocated by some. This hand is referred to as the "bow hand" and its arm the "bow arm". The opposite hand is called the "drawing hand" or "string hand". Terms such as "bow shoulder" or "string elbow" follow the same convention. Right-eye-dominant archers hold the bow with their left hand, have their left side facing the target, sight towards the target with their right eye and handle the arrow and string with their right hand.

To shoot an arrow, an archer first assumes the correct stance. The body is perpendicular to the target and the shooting line, with the feet placed shoulder-width apart. As an archer progresses from beginner to a more advanced level, an "open stance" is often utilized. Each archer will have a particular preference, but mostly this term indicates that the leg furthest from the shooting line will be a half to a whole foot-length in front of the other, on the ground.

To load, the bow is pointed toward the ground and the shaft of the arrow is placed on an arrow rest which is attached in the bow window. The back of the arrow is attached to the bowstring with the "nock", a small plastic component which is characterized by a "v" groove for this purpose. This is referred to as "nocking the arrow". Typical arrows, having three vanes, are oriented such that a single vane is pointing away from the bow.

The bowstring and arrow are held with three fingers. When using a sight, the index finger is placed above the arrow and the next two fingers below. The string is usually placed in either the first or second joint of the fingers. The bow is then raised and drawn. This is often performed as one fluid motion, which tends to vary from archer to archer. The string hand is then drawn toward the face, where it should rest lightly at an anchor point. This point is consistent from shot to shot and is usually at the corner of the mouth or on the chin. The bow arm is held outwards toward the target. The elbow of this arm should be rotated so that the inner elbow is parallel to the ground.

In proper form, the archer stands erect, forming a T-shape with his or her body. The archer's lower trapezius muscles are used to pull the arrow to the anchor point. Some bows are equipped with a mechanical device, called a clicker, which produces a clicking sound when the archer reaches the correct draw length.

The arrow is typically released by relaxing the fingers of the drawing hand. Usually, this type of release aims to keep the drawing arm rigid and move it back using the back muscles, as opposed to using arm motion. An archer should also pay attention to the recoil or follow through of his or her body, as it may indicate problems with form.

Training for archery typically involves the actual practice of archery, using an actual bow and arrow and performing as described above. However, in order to train, the archer must travel to an archery range, transport his or her bow and arrows, and exercise the appropriate safety measures. In inclement weather or simply when it is inconvenient to travel with the archery equipment, it would be desirable to provide a training device which is simulative of actual archery. Further, as most archers typically only have one bow, there is no opportunity for the archer to build his or her archery-related muscles beyond the tension and weight provided by that particular bow. It would be desirable to provide a training device allowing for variation in tension and weight, thus allowing the user to exercise with varying force and technique.

Thus, an archery training device solving the aforementioned problems is desired.

SUMMARY OF THE INVENTION

The archery training device allows an archer to properly train his or her muscles, as well as train for proper archery technique. The archery training device includes a substantially cylindrical support having a plurality of pairs of apertures formed therethrough. Preferably, the plurality of pairs of apertures are linearly aligned along an axial direction of the support.

A plurality of elastic members are further provided, each member having opposed first and second ends, which are respectively received within one of the plurality of pairs of apertures. The first and second ends of the plurality of elastic members are secured to the support. An optional elastic band having opposed upper and lower ends may be additionally provided, with the upper end thereof being releasably secured to the support or, preferably, attached to the user's wrist. The lower end of the optional elastic band is adapted for being held against a support surface, such as the ground, by the foot of the archer. It should be understood that the elastic band is both removable and optional.

Additionally, a similarly optional elastic band for providing resistance coupled with other parts of the body, rather than the wrist and/or foot, may be utilized. In use, the archer grasps the support with one hand (i.e., the user's bow hand) and grasps a selected number of the plurality of elastic members with the other hand (i.e., the string hand) to simulate a string pull of an archery bow. When using the optional elastic band, the elastic band provides a downward, elastic force for exercising the archer's holding shoulder.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
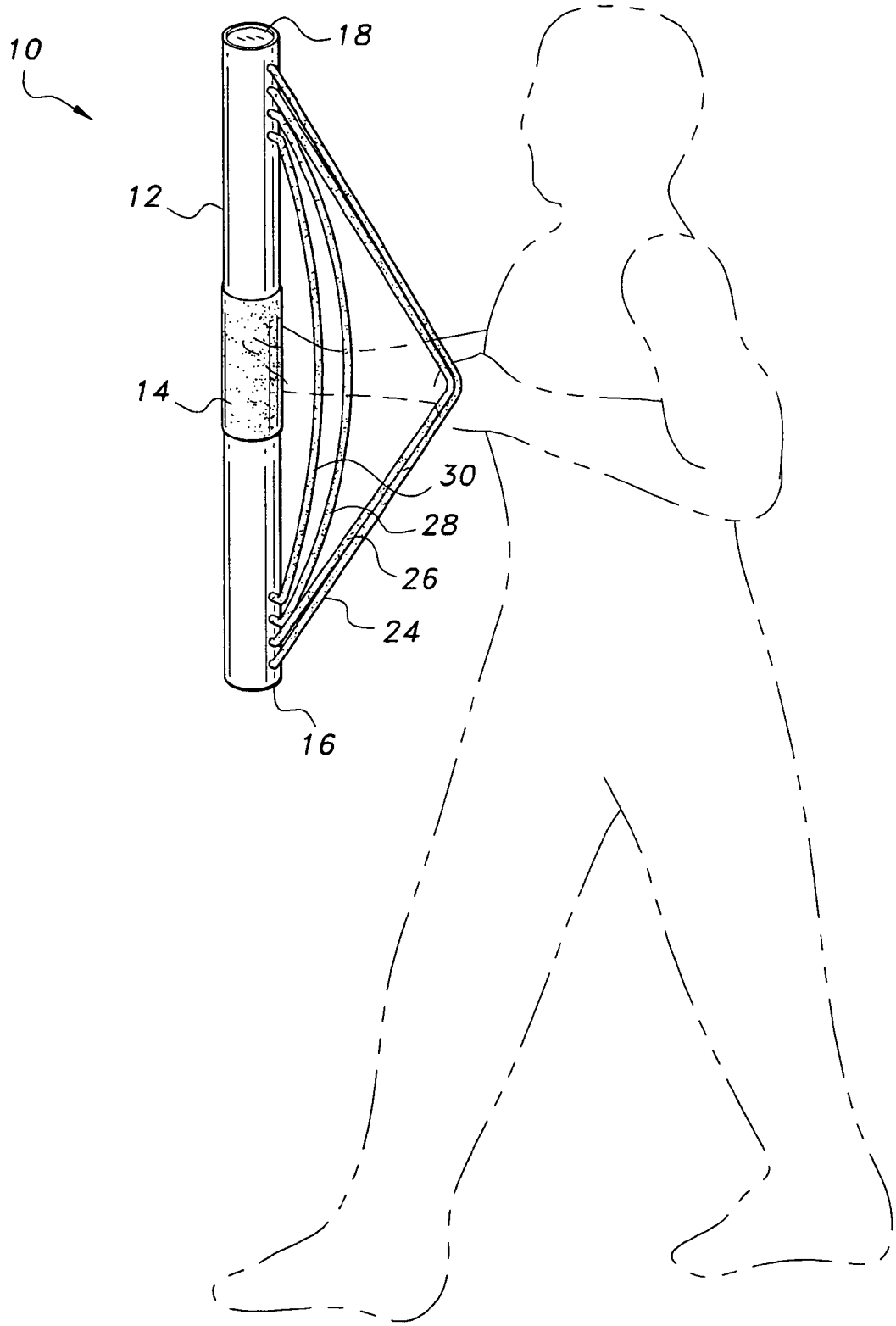
FIG. 1A is an environmental, perspective view of an archery training device according to the present invention.
Figure 1B:
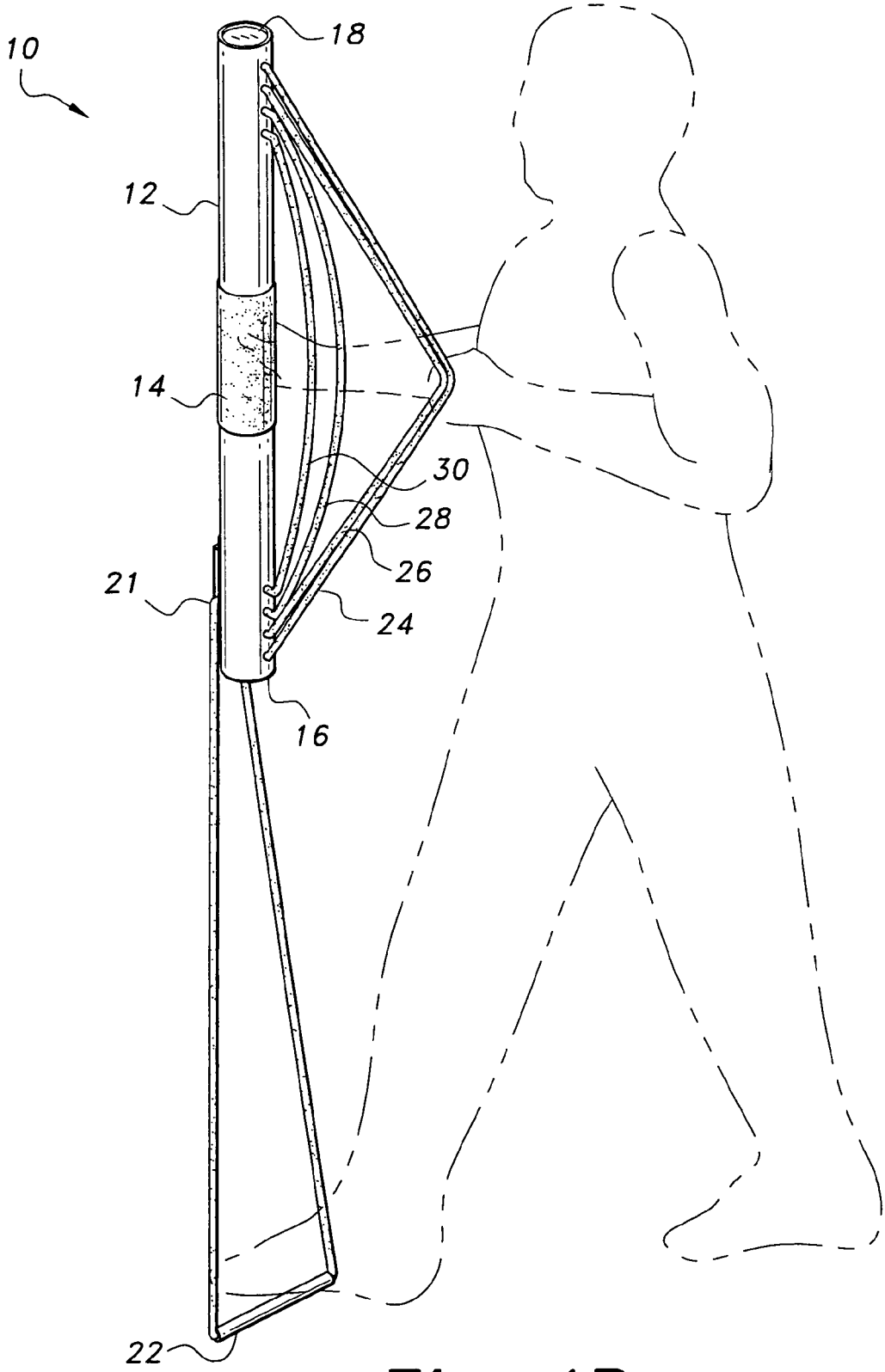
FIG. 1B is an environmental, perspective view of the archery training device of FIG. 1A with an optional elastic band attached.
Figure 2:
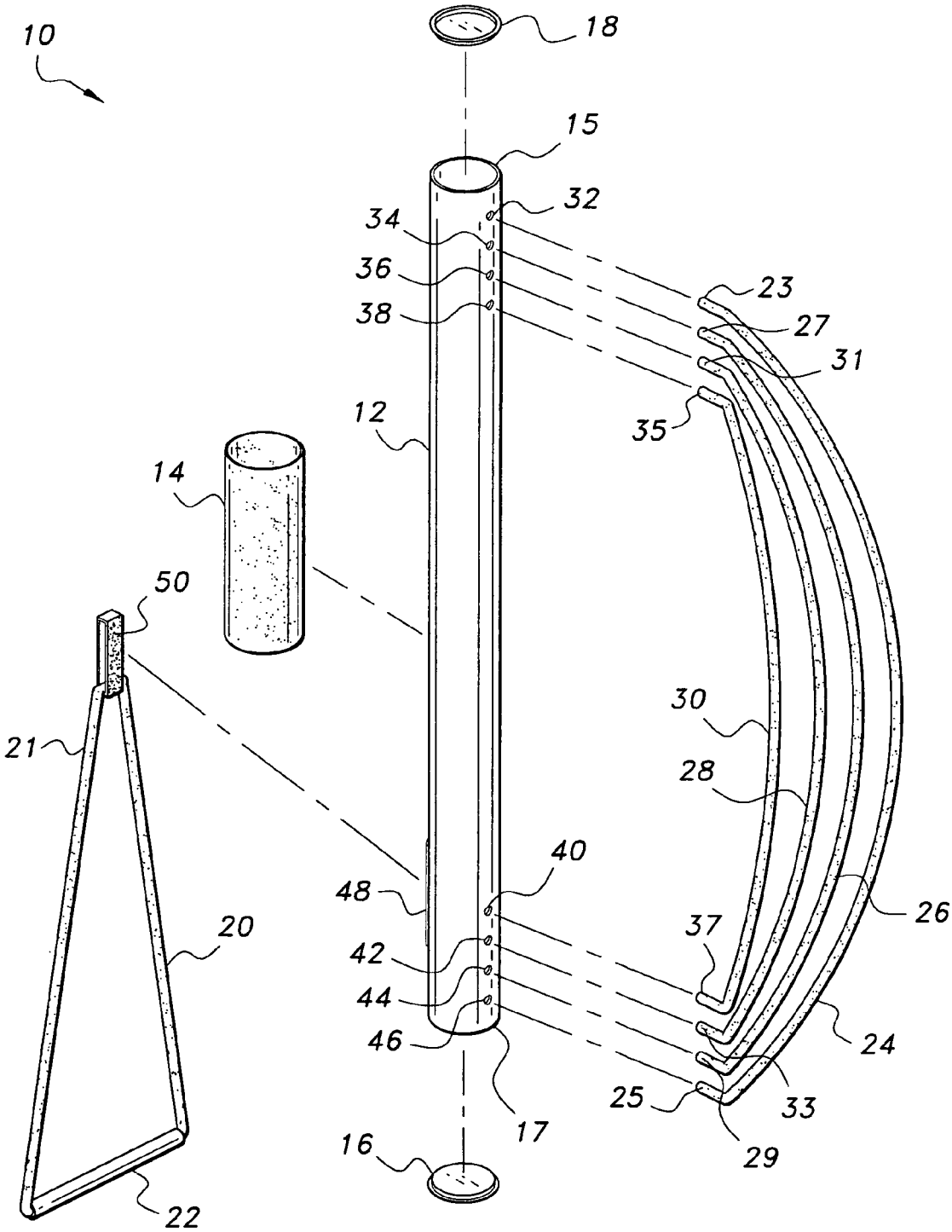
FIG. 2 is an exploded side view of the archery training device according to the present invention.

Referring to FIGS. 1A, 1B and 2, the archery training device 10 allows the user to properly train his or her muscles, as well as train for proper archery technique. As noted above, to shoot an arrow, an archer first assumes what is considered a proper archery stance. In this stance, the archer's body is perpendicular to the target and the shooting line, with the feet placed shoulder-width apart. The bowstring and arrow are held with three fingers. The bow is then raised and drawn. This is often performed as one fluid motion, which tends to vary from archer to archer. The string hand is drawn towards the face, where it rests lightly at an "anchor point." This point is consistent from shot to shot and is usually at the corner of the mouth or on the chin. The bow arm is held outwards toward the target. The elbow of this arm is rotated so that the inner elbow is parallel to the ground.

In proper form, the archer stands erect, with the archer's lower trapezius muscles being used to pull the arrow to the anchor point. As shown in FIG. 1A, the training device 10 allows the user to practice his form as well as exercise or train the muscles of his or her string arm, as well as the muscles in his or her bow shoulder of the bow arm.

The archery training device 10 includes a support 12, which is preferably substantially tubular, as shown, providing not only a gripping surface or handhold for the user, but simulating the limbs of an archery bow. Support 12 may be formed as a hollow tube, having a substantially cylindrical contour, as shown. As best seen in FIG. 2, support 12 may have open upper and lower ends, 15, 17, respectively, with upper and lower ends 15, 17 being releasably sealed by end caps 16, 18. Support 12 may be formed from any suitable resilient material, such as, for example, schedule 40 polyvinyl chloride, fiberglass or the like.

As shown, a gripping member 14, formed from foam or the like, may be mounted substantially centrally on support 12, similar to the grip on a conventional archery bow. The cylindrical support 12 and gripping member 14 allow the support to be held by the user's left or right hand. A plurality of pairs of apertures are formed through the support 12, with the apertures preferably being linearly aligned.

In FIGS. 1A, 1B and 2, four pairs of apertures 32, 46; 34, 44; 36, 42; and 38, 40 are formed through support 12. Pair 32, 46 respectively receives the upper and lower ends 23, 25 of elastic member 24; pair 34, 44 respectively receives the upper and lower ends 27, 29 of elastic member 26; pair 36, 42 respectively receives the upper and lower ends 31, 33 of elastic member 28; and pair 38, 40 respectively receives the upper and lower ends 35, 37 of elastic member 30. Elastic members 24, 26, 28 and 30 are preferably elastic bands, such as are conventionally known in the field of exercise equipment, and may be made from natural rubber latex or any other suitable elastic material. An example of such elastic bands is manufactured under the name Thera-Band® by The Hygenic Corporation of Delaware.

As shown, elastic members 24, 26, 28 and 30 are provided in differing lengths, with elastic member 30 having the smallest length and elastic member 24 having the greatest length. The elastic members 24, 26, 28 and 30 may also vary in elastic resistance, with each elastic member having a unique spring constant associated therewith. In FIG. 1A, the user is shown gripping and pulling elastic members 24, 26. By providing multiple elastic members, having differing lengths and differing resistances, the user may vary his or her exercise regimen by gripping differing combinations of the elastic members 24, 26, 28 and 30. The spring constants of each elastic band may be varied by any suitable method, such as providing bands of differing materials, differing diameters, etc. It should be understood that the four elastic members shown in FIGS. 1A, 1B and 2 are shown for exemplary purposes only, and that any desired number of elastic members may be utilized, along with a corresponding number of pairs of apertures formed through support 12. The ends of each of the elastic members are inserted through the respective, corresponding apertures and may be secured to support 12 by any suitable means of securement, such as the formation of knots in the ends following insertion, the addition of plugs to hold the ends of the bands in the apertures or the like.

As noted above, in addition to exercising the user's string arm, the user may exercise his or her bow shoulder as well as the muscles of the bow arm. When the user grips gripping member 14 with his or her bow hand, the weight of the device 10 causes the user to exercise his or her shoulder muscles of the bow arm, in order to maintain support 12 in a vertical orientation. As shown in FIG. 1B, in addition to the downward force caused by the weight of support 12, the user may add additional downward force with an additional, optional elastic band 20. Elastic band 20 may be formed from the same material as elastic members 24, 26, 28 and 30.

As best shown in FIG. 1B, an upper end 21 of elastic band 20 is secured to support 12. A foot support 22, which may be in the form of plastic tube having a diameter of approximately ½ an inch or the like, is mounted centrally on the elastic band 20, allowing the user to press the lower end of the elastic band 20 to the floor. This causes the elastic band 20 to stretch, thus causing a downward, elastic force which the user must counteract, thus building strength in his or her bow shoulder, as well as the other muscles in the user's bow arm and back.

As best shown in FIG. 2, the elastic band 20 is releasably and removably attached to the support 12. Any suitable releasable attachment may be utilized, such as, for example, hook and loop fasteners 48, 50. As shown hook fastener 48 is secured to support 12, preferably opposite the elastic bands and adjacent lower end 17, and loop fastener 50 is secured to the upper end 21 of elastic band 20. It should be understood that the elastic band 20 is both removable and optional. Additionally, a similarly optional elastic band for providing resistance coupled with other parts of the body, rather than the wrist and/or foot, may be utilized.

Figure 3:
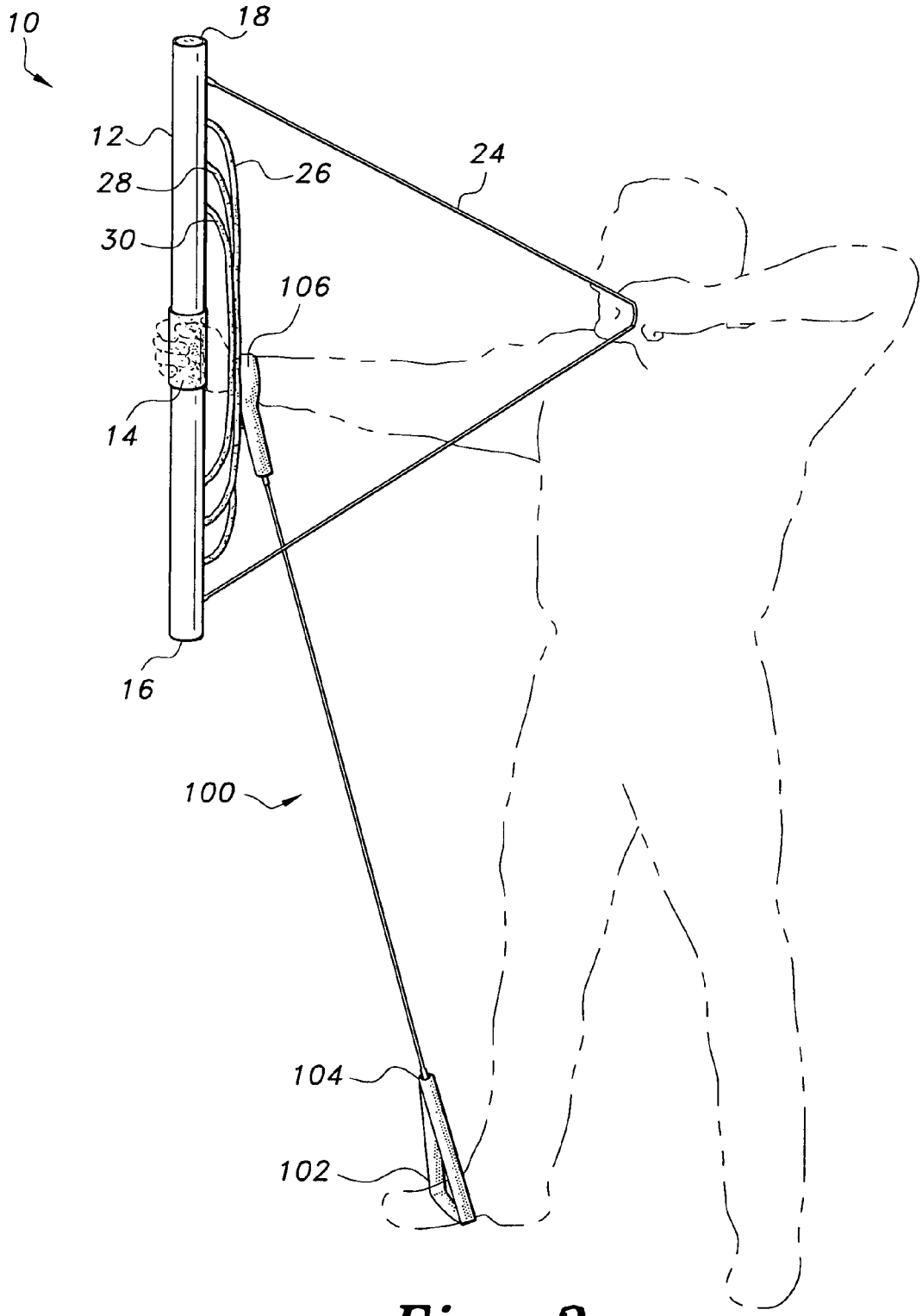
FIG. 3 is an environmental, perspective view of an alternative embodiment of the archery training device according to the present invention.

As a further alternative, a band 100, as shown in FIG. 3, is preferably provided in combination with the archery training device 10 to form an archery training kit. Band 100 is similar to optional elastic band 20, having a lower end 104 adapted for receiving the user's foot and a foot support 102. However, rather than being removably secured to member 12, the upper end of band 100 is releasably and adjustably secured about the user's wrist, by any suitable type of removable and/or releasable wrist-mounted support 106. Preferably, the wrist-mounted support 106 is secured about the wrist of the user which grips gripping member 14, as shown.

It is to be understood that the present invention is not limited to the embodiments described above, but encompasses any and all embodiments within the scope of the following claims.

I claim:

1. A method of training for archery, comprising the steps of:

providing an archery training device, the training device including;

i) a support having a longitudinal axis and a midpoint, a plurality of pairs of apertures formed therein and being equally divided about the midpoint, the pairs of apertures being linearly aligned along and parallel to the axial direction of the support;

ii) a gripping member mounted substantially centrally about the support; and iii) a plurality of elastic members, each of the elastic members having opposed first and second free ends respectively received within one of the pairs of apertures thereby defining different lengths of linearly aligned elastic members, the first and second ends of the plurality of elastic members being secured to the support at their respective apertures, each of the elastic members having a spring constant associated therewith, wherein at least one of the elastic members has a unique spring constant associated therewith;

grasping the support with one of a user's hands;

grasping a selected number of the plurality of elastic members with the other hand; and pulling the grasped plurality of elastic members toward the user's torso while maintaining the support in a substantially vertical orientation.

2. An archery training device, comprising:

a support having a longitudinal axis and a midpoint, a plurality of pairs of apertures formed therein and being equally divided about the midpoint, the pairs of apertures being linearly aligned along and parallel to the axial direction of the support;

a gripping member mounted substantially centrally about the support; and a plurality of elastic members, each of the elastic members having opposed first and second free ends respectively received within one of the pairs of apertures thereby defining different lengths of linearly aligned elastic members, the first and second ends of the plurality of elastic members being secured to the support at their respective apertures, each of the elastic members having a spring constant associated therewith, wherein at least one of the elastic members has a unique spring constant associated therewith;

whereby the user grasps the gripping member with one hand and grasps a selected number of the plurality of elastic members with the other hand to simulate a string pull of an archery bow.

3. The archery training device as recited in claim 2, wherein said support comprises a substantially cylindrical hollow tube.

4. The archery training device as recited in claim 3, further comprising a pair of caps for sealing a pair of open ends of the hollow tube.

5. The archery training device as recited in claim 2, further comprising an elastic band having opposed upper and lower ends, the upper end thereof being adapted for releasable securement to the user's wrist, the lower end being adapted for being held against a support surface by the user.

6. The archery training device as recited in claim 5, further comprising a foot support mounted on the lower end of the elastic band.

7. The archery training device as recited in claim 2, further comprising an elastic band having opposed upper and lower ends, a releasable fastener releasably securing the upper end of the elastic band to a lower end of the support and a foot support mounted on the lower end of the elastic band.

8. The archery training device as recited in claim 7, wherein the releasable fastener comprises a hook and loop fastener.

9. The archery training device as recited in claim 2, wherein each of the elastic members has a unique spring constant associated therewith.

10. The archery training device as recited in claim 2, wherein the at least one elastic member having the unique spring constant defines the shortest length of the linearly aligned elastic members.

* * * * *